US008454107B2

(12) United States Patent
Kuo

(10) Patent No.: US 8,454,107 B2
(45) Date of Patent: Jun. 4, 2013

(54) PRINTER HAVING PRINTER HEAD ADJUSTMENT ASSEMBLY

(75) Inventor: Ching-Ju Kuo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 19 days.

(21) Appl. No.: 13/206,528

(22) Filed: Aug. 10, 2011

(65) Prior Publication Data

US 2013/0010029 A1 Jan. 10, 2013

(30) Foreign Application Priority Data

Jul. 4, 2011 (TW) ..... 100123474 A

(51) Int. Cl.
*B41J 2/165* (2006.01)

(52) U.S. Cl.
USPC ..... 347/8

(58) Field of Classification Search
None
See application file for complete search history.

(56) References Cited

U.S. PATENT DOCUMENTS

| | | | | |
|---|---|---|---|---|
| 6,705,693 | B2 * | 3/2004 | Lim et al. | 347/8 |
| 6,874,956 | B2 * | 4/2005 | Kelley et al. | 400/59 |
| 2001/0020765 | A1 * | 9/2001 | Araki et al. | 271/125 |

* cited by examiner

*Primary Examiner* — Matthew Luu
*Assistant Examiner* — Alejandro Valencia
(74) *Attorney, Agent, or Firm* — Altis Law Group, Inc.

(57) ABSTRACT

A printer includes a hanger, a printer head, a carriage, and an adjustment assembly. The hanger includes a base and a board above the base. The carriage includes a body, a rod, and an actuator. The body is rotatably connected to the rod. The actuator is rotatably connected to the body. The actuator includes a projection and a resisting member. The adjustment assembly includes a protruding post. When the body moves in a first direction, the projection applies a push force to the protruding post, the protruding post rotates downward. When the body moves in a reverse, second direction, the protruding post applies a push force to the projection, which causes the actuator to rotate, the lateral surface of the resisting member stays in contact with the board during the rotation of the actuator, causing the carriage to rotate, the distance between the printer head and the base is changed.

11 Claims, 9 Drawing Sheets

PRINTER HAVING PRINTER HEAD ADJUSTMENT ASSEMBLY

BACKGROUND

1. Technical Field

The present disclosure relates to printers and, particularly, to a printer having head gap adjustment assembly.

2. Description of Related Art

Because different print medium may have different thickness, an adjustment assembly is needed to adjust the distance between the printer head and the print medium. However, the conventional adjustment assembly is expensive to manufacture. Thus, it is desired to provide a printer with a new adjustment assembly to overcome the described problems.

BRIEF DESCRIPTION OF THE DRAWINGS

The components of the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Embodiments of the present disclosure are now described in detail, with reference to the accompanying drawings.

Figure 1:
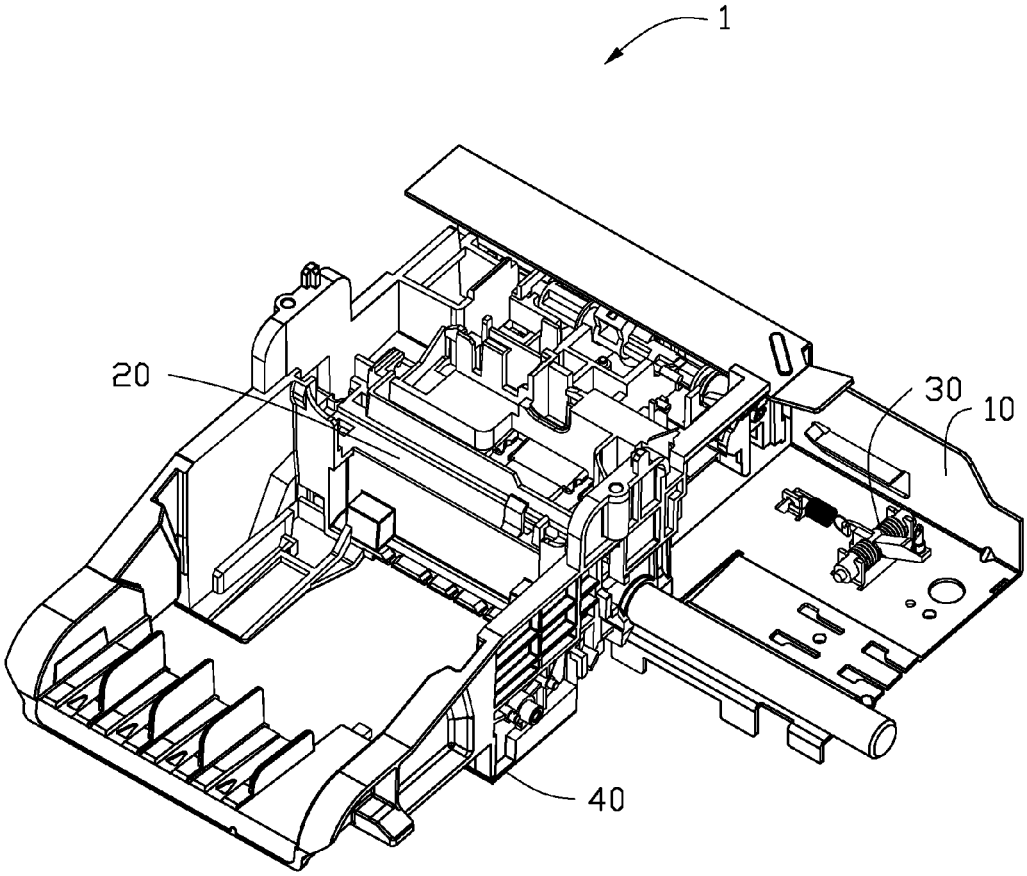
FIG. 1 is an isometric view of a printer in accordance with an exemplary embodiment, with certain elements omitted for clarity.

Referring to FIG. 1, a printer 1 in accordance with an exemplary embodiment is shown. The printer 1 includes a hanger 10, a carriage 20, and an adjustment assembly 30. The adjustment assembly 30 is arranged on the hanger 10. A printer head 40 is attached to one end of the carriage 20 and used to print information on a print medium.

Figure 2:
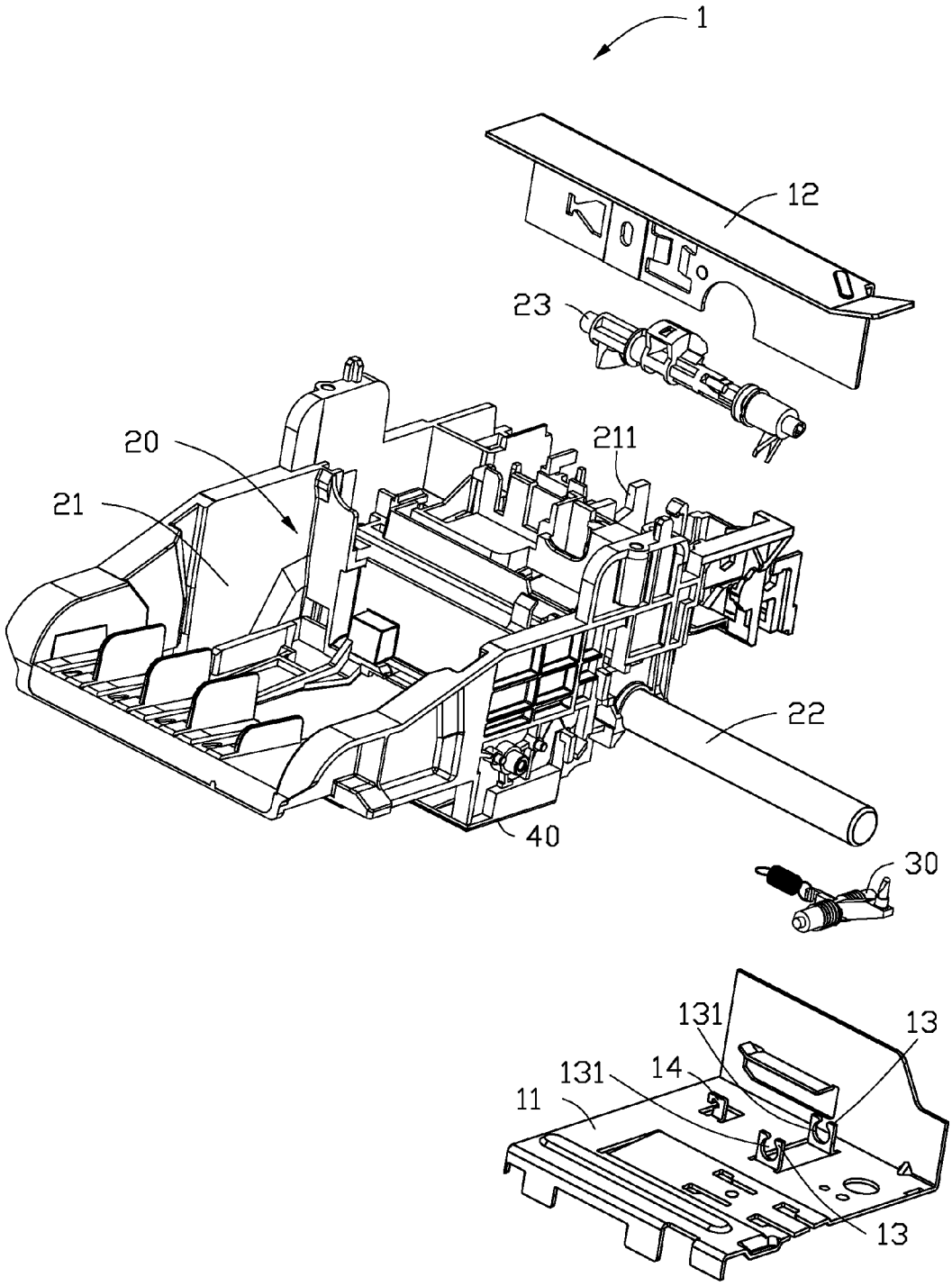
FIG. 2 is an isometric, exploded view of the printer of the FIG. 1.

Referring to FIG. 2, the hanger 10 includes a base 11 and a board 12. The board 12 is fixed to the base 11 and above the base 11. Two positioning members 13 and a securing member 14 protrude from the base 11. Each positioning member 13 defines a hollow 131 to receive a portion of the adjustment assembly 30.

Figure 3:
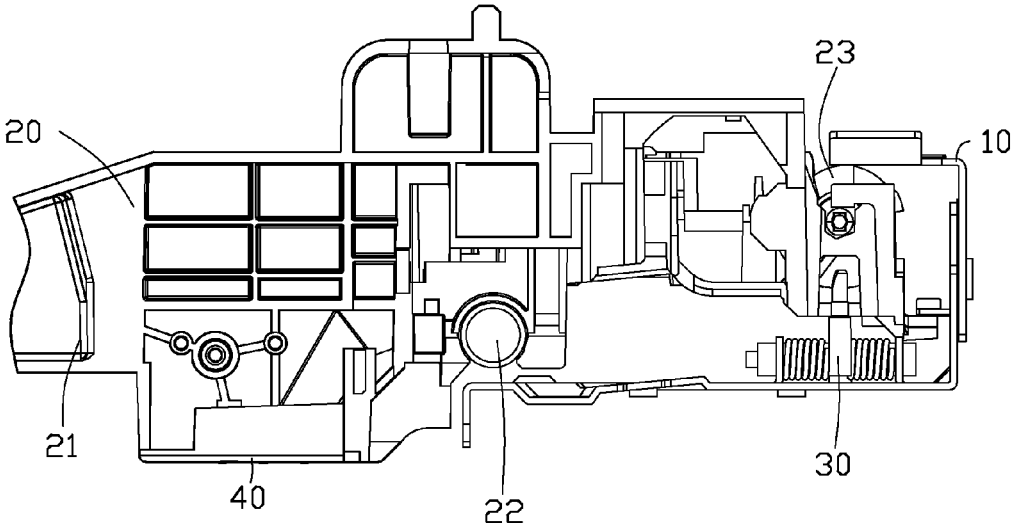
FIG. 3 is a planar side view of the printer of the FIG. 1.

The carriage 20 includes a body 21, a rod 22, and an actuator 23. The body 21 is rotatably mounted on the rod 22, and capable of sliding along the rod 22. The actuator 23 and the printer head 40 are respectively arranged on two opposite ends of the body 21, and located at opposite sides of the rod 22. Referring also to FIG. 3, when the body 21 rotates clockwise, the actuator 23 moves downward while the printer head 470 moves upward. The body 21 includes a limiting member 211. The actuator 23 is rotatably received in the limiting member 211, and is capable of rotating relative to the body 21.

Figure 4:
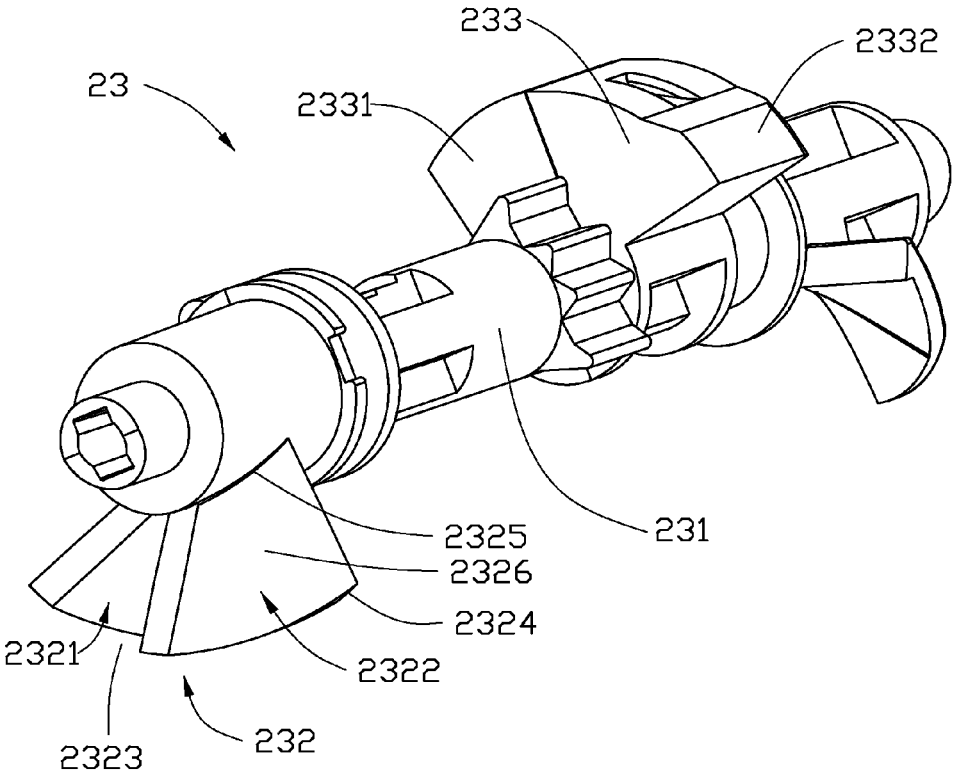
FIG. 4 is an isometric view of an actuator of the printer of the FIG. 2.

Referring to FIG. 4, the actuator 23 includes a shaft 231, a projection 232, and a resisting member 233. The projection 232 and the resisting member 233 protrude from the lateral surface of the shaft 231. In an initial state, the projection 232 is below the shaft 231. In the embodiment, the projection 232 includes a first curved tab 2321 and a second curved tab 2322. A gap 2323 is formed between the first curved tab 2321 and the second curved tab 2322. The first curved tab 2321 is the same as the second curved tab 2322. One terminal of a free end 2324 of the curved tab 2321, 2322 (far away from the resisting member 233) and another terminal of the free end 2324 of the curved tab 2321, 2322 (adjacent to the resisting member 233) are respectively located on two side of one protruded end 2325 of the curved tab 2321, 2322. A smooth surface 2326 is formed between the free end 2324 and the protruded end 2325. The resisting member 233 has a spiral lateral surface. That is, the distance between the lateral surface of the resisting member 233 and the rotation axis of the shaft 231 gradually becomes greater from one end 2331 of the resisting member 233 to the opposite end 2332 of the resisting member 233. Namely, the distance between the end 2331 and the rotation axis of the shaft 231 is less than the distance between the opposite end 2332 and the rotation axis of the shaft 231.

Figure 5:
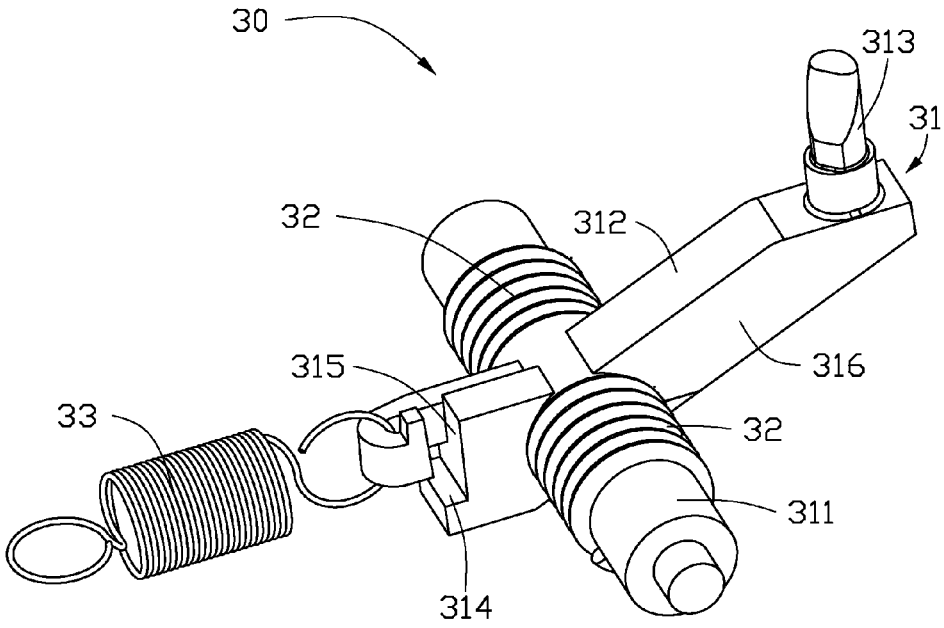
FIG. 5 is an isometric view of an adjustment assembly of the printer of the FIG. 2.
Figure 6:
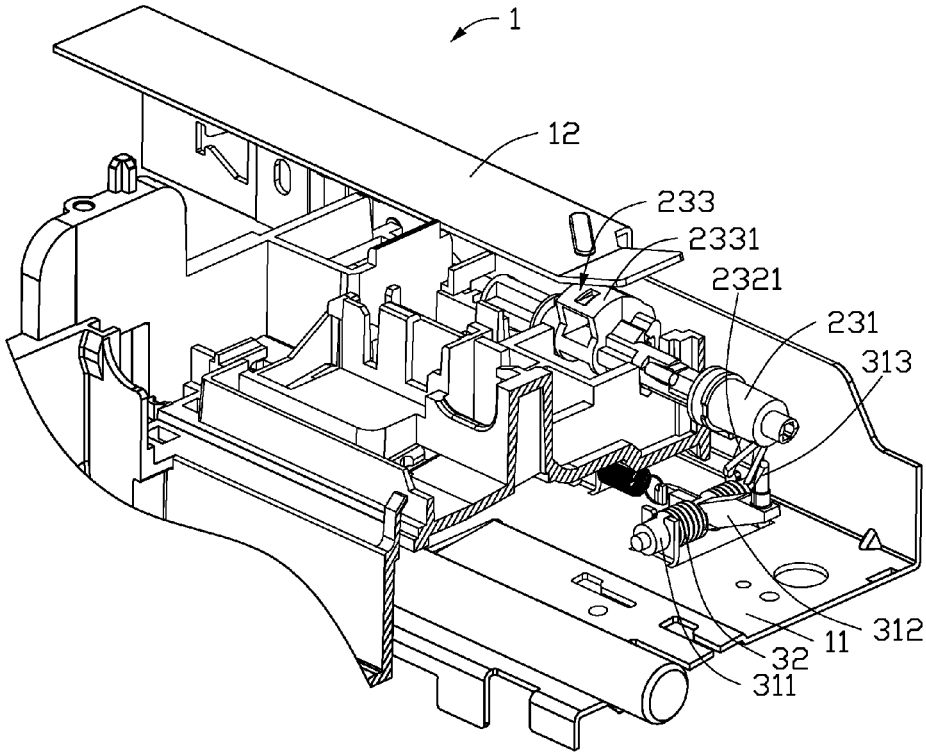
FIG. 6 is an isometric, cutaway view of the printer of FIG. 1, showing the actuator of FIG. 4 moving in a first direction and contacting the adjustment assembly.

Referring to FIG. 5, the adjustment assembly 30 includes a main body 31, a first elastic member 33, and two second elastic members 32. The main body 31 includes a rod 311, a block 312, a protruding post 313, and a stopping member 314. In the embodiment, the rod 311, the block 312, the protruding post 313 and the stopping member 314 are integrally formed. Referring to FIG. 6, two ends of the rod 311 are rotatably received in the hollow 131 of each positioning member 13. The block 312 includes a first portion 315 and a second portion 316 that both protrude from the lateral surface of the rod 311 and are inclined to each other. The protruding post 313 protrudes from the second portion 316 of the block 312. In the embodiment, the protruding post 313 is cylindrical, and the diameter of the protruding post 313 is slightly less than the gap 2323 formed by the first curved tab 2321 and the second curved tab 2322.

In an initial state, the protruding post 313 is opposite to the gap 2323 formed by the first curved tab 2321 and the second curved tab 2322. The stopping member 314 protrudes from the first portion 315 of the block 312 and resists against the base 11. The second elastic members 32 are respectively sleeved on two opposite ends of the rod 311. One end of each second elastic member 32 is fixed to one positioning member 13, and the opposite end of each second elastic member 32 is fixed to the block 312. One end of the first elastic member 33 is connected to the block 312, and the opposite end of the first elastic member 33 is connected to the securing member 14. The first elastic members 33 and the second elastic member 32 can provide a rebound force to the adjustment assembly 30.

Figure 7:
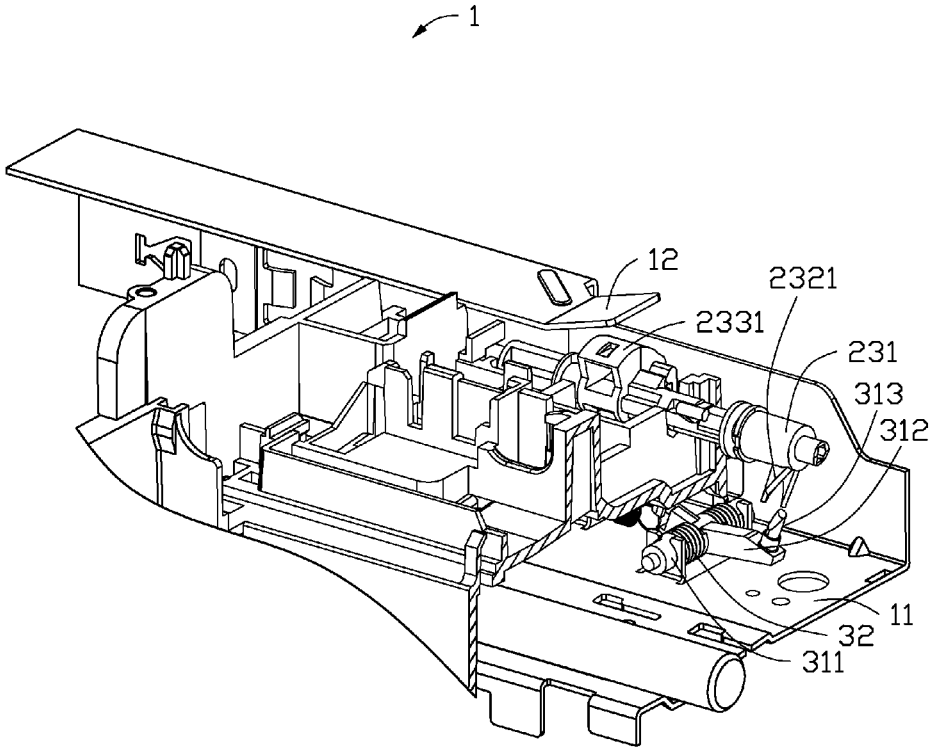
FIG. 7 is similar to FIG. 6, but showing the actuator of FIG. 4 moving in the first direction and disengaging from the adjustment assembly.
Figure 8:
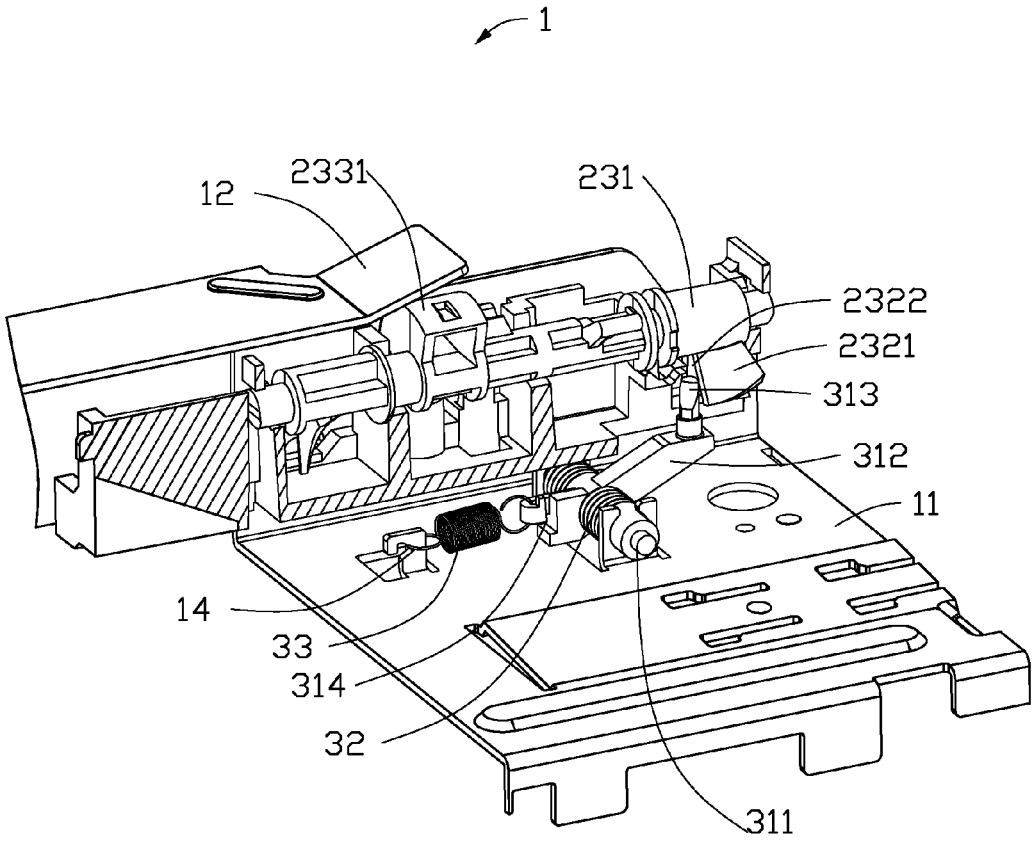
FIG. 8 is an isometric, cutaway view of the printer of FIG. 1, showing the actuator of FIG. 4 moving in a second direction and contacting the adjustment assembly.
Figure 9:
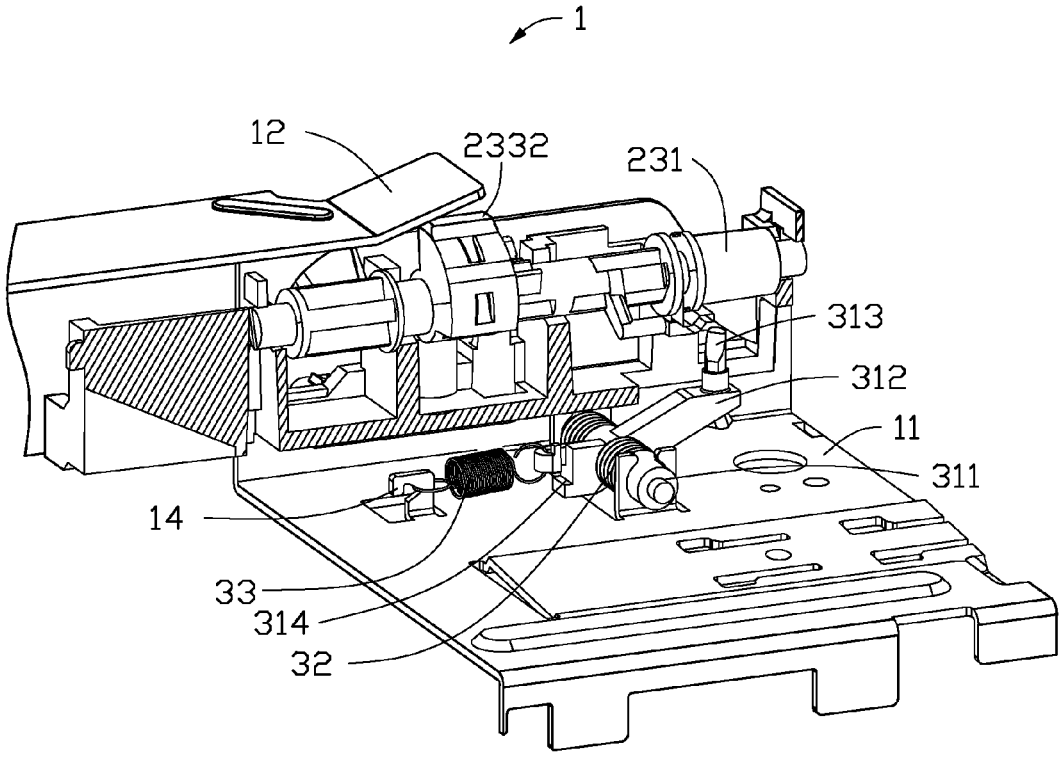
FIG. 9 is similar to FIG. 8, but showing the actuator of FIG. 4 moving in the second direction and disengaging from the adjustment assembly.

Referring to FIGS. 6-8, when starting to adjust the printer head 40, a first processor (not shown) controls a motor (not shown) to control the body 21 to move in the first direction along the rod 22 in response to an operation of the user. The first direction is the direction toward the adjustment assembly 30. After a predetermined time period, the first processor (not shown) further controls the motor (not shown) to control the body 21 to move back in a second, reverse direction along the rod 22.

When the body 21 moves a distance toward the actuator 30, the first curved tab 2321 can contact the protruding post 313 and apply a downward force to the protruding post 313. The protruding post 313 then rotates under the driving force of the first curved tab 2321 until the first curved tab 2321 is completely out of contact with the protruding post 313. When the protruding post 313 rotates under the driving force of the first curved tab 2321, the second portion 316 of the block 312 moves downward, which causes the first elastic members 33 and the second elastic member 32 to be stretched (see FIG. 7).

Referring to FIG. 8, after the first curved tab 2321 is completely out of contact with the protruding post 313, the protruding post 313 rebounds to the initial state under the rebound force of the first elastic members 33 and the second elastic member 32. When the body 21 moves back a distance in the second direction, the second curved tab 2322 can contact the protruding post 313 and apply a push force to the protruding post 313. Because the stopping member 233 resists against the base 11, the protruding post 313 will keep still. The protruding post 313 then applies a push force to the second curved tab 2322, causing the shaft 231 to rotate.

During the rotation of the shaft 231, the outer surface of the resisting member 233 stays in contact with the board 12. Because the distance between the outer surface of the resisting member 233 and the rotation axis gradually becomes greater from the end 2331 to the opposite end 2332, the distance between the board 12 and the rotation axis of the shaft 231 gradually becomes greater during the rotating of the shaft 231, namely, the end of the carriage 20 containing the actuator 30 moves downward. The opposite end of carriage 20 containing the printer head 40 then moves upward. As a result, the distance between the printer head 40 and the print medium is adjusted.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A printer comprising:

a hanger comprising a base and a board attached to the base and above the base;

a printer head;

a carriage comprising:

a body;

a rod, to which the body is rotatably connected; and an actuator rotatably connected to the body, the actuator comprising a projection and a resisting member, the resisting member comprising a lateral surface, a distance between the lateral surface of the resisting member and a rotation axis of the actuator that rotates about gradually becoming greater from one end of the resisting member to an opposite end of the resisting member, the actuator and the printer head being respectively arranged on opposite ends of the body and located at opposite sides of the rod; and an adjustment assembly rotatably connected to the base, and comprising a first elastic member and a protruding post, the first elastic member being configured to provide a rebound force to the protruding post;

wherein when the body moves in a first direction, the projection contacts the protruding post and applies a push force to the protruding post, the protruding post rotates downward and the first elastic member is stretched until the projection is out of contact with the protruding post, after the projection is out of contact with the protruding post, the protruding post rebounds to an initial state under the rebound force of the first elastic member and resists against the base; and when the body moves back in a reverse, second direction, the projection contacts the protruding post, the protruding post applies a push force to the projection, which causes the actuator to rotate, the lateral surface of the resisting member stays in contact with the board during the rotation of the actuator, the body is urged by the lateral surface to rotate, causing the carriage to rotate, thereby the distance between the printer head and the base is changed.

2. The printer as described in claim 1, wherein the projection comprising a first curved tab and a second curved tab, one terminal of the free end of the first curved tab and another terminal of the free end of the first curved tab are respectively located on two side of the protruded end of the first curved tab, one terminal of the free end of the second curved tab and another terminal of the free end of the second curved tab are respectively located on two side of the protruded end of the second curved tab, the free end and the protruded form a smooth surface.

3. The printer as described in claim 2, wherein a diameter of the protruding post is less than a gap formed between the first curved tab and the second curved tab.

4. The printer as described in claim 1, wherein two hollow positioning members protrude from the base, the adjustment assembly comprises a rod and a block, two ends of the rod are rotatably received in the hollow of each of the positioning members, the block is fixed to the rod, the block comprises a first portion and a second portion that are inclined to each other, the first portion and the second portion protrude from the lateral surface of the rod, the protruding post protrudes from the second portion of the block, a first end of the first elastic member is fixed to the block, and the opposite end of the first elastic member is fixed to the base.

5. The printer as described in claim 4, wherein the adjustment assembly further comprises two second elastic members respectively sleeved on two ends of the rod, one end of each of the second elastic members is fixed to the positioning member, and the opposite end of each of the second elastic members is fixed to the block.

6. The printer as described in claim 1, wherein the protruding post further comprises a stopping member resisting against the base.

7. The printer as described in claim 6, wherein the stopping member and the protruding post are integrally formed.

8. The printer as described in claim 5, wherein the projection comprising a first curved tab and a second curved tab, one terminal of the free end of the first curved tab and another terminal of the free end of the first curved tab are respectively located on two side of the protruded end of the first curved tab, one terminal of the free end of the second curved tab and another terminal of the free end of the second curved tab are respectively located on two side of the protruded end of the second curved tab, the free end and the protruded form a smooth surface.

9. The printer as described in claim 8, wherein a diameter of the protruding post is less than a gap formed between the first curved tab and the second curved tab.

10. The printer as described in claim 9, wherein the protruding post further comprises a stopping member resisting against the base.

11. The printer as described in claim 10, wherein the stopping member and the protruding post are integrally formed.

* * * * *